US005740781A

United States Patent [19]

Scott et al.

[11] Patent Number: 5,740,781

[45] Date of Patent: Apr. 21, 1998

[54] STARTING SYSTEM FOR AN INTERNAL COMBUSTION ENGINE

[75] Inventors: William A. Scott; Gary L. Baumbarger, both of Decatur; John G. Easter, Blue Mound, all of Ill.

[73] Assignee: Tillotson, Ltd., Ireland

[21] Appl. No.: 647,236

[22] Filed: May 9, 1996

[51] Int. Cl.[6] ..... F02M 1/16

[52] U.S. Cl. ..... 123/437; 123/179.11; 123/179.18; 123/339.13; 261/45; 261/DIG. 8

[58] Field of Search ..... 123/339.13, 179.11, 123/179.12, 179.13, 179.16, 179.18, 437, 438, 439; 261/45, 63, 121.4, DIG. 8

[56] References Cited

U.S. PATENT DOCUMENTS

| | | | |
|---|---|---|---|
| 4,181,108 | 1/1980 | Bellicardi | 261/121.4 |
| 4,360,482 | 11/1982 | Asai | 261/121.4 |
| 4,499,887 | 2/1985 | Billingsley et al. | 123/575 |
| 4,519,367 | 5/1985 | Nomura | 123/179.18 |
| 4,542,723 | 9/1985 | Fujimoto | 123/179.16 |
| 4,738,232 | 4/1988 | Scott | 123/179.11 |
| 5,014,673 | 5/1991 | Fujimoto et al. | 123/179.16 |

*Primary Examiner*—Andrew M. Dolinar

*Attorney, Agent, or Firm*—Harness, Dickey & Pierce, P.L.C.

[57] ABSTRACT

A starting system for an internal combustion engine is provided for enhancing engine startability and performance by simultaneously controlling the volume of air flowing through a carburetor and the ratio of an air/fuel mixture through a single manual operation. The starting system is constructed to utilize atmospheric air control feed back to a carburetor and includes a piston disposed with a chamber which accesses two atmospheric ports. When the piston is positioned to fully close a first of the ports, a second of the ports is fully open. Similarly, when the piston fully opens the second port, the first port is fully closed. The two atmospheric ports access the carburetor idle system and intake manifold of the engine respectively. For starting of the engine in cold temperatures, the starting system also includes a fuel prime arrangement for enriching the ratio of air/fuel delivered to the engine. The fuel prime arrangement includes a primer pawl interconnected to the piston which depresses a prime bulb upon selective movement of the piston.

24 Claims, 2 Drawing Sheets

STARTING SYSTEM FOR AN INTERNAL COMBUSTION ENGINE

BACKGROUND

1. Field of the Invention

The present invention generally relates to a starting system for an internal combustion engine. More particularly, the present invention relates to a starting system for an internal combustion engine for enhancing engine startability by incorporating a control assembly for controlling the volume and ratio of an air/fuel mixture delivered to the engine.

2. Discussion

In a typical small internal combustion engine of the reciprocating type, such as a two-cycle engine or a four-cycle engine, an air/fuel mixture is introduced into a piston chamber and compressed therein upon the upstroke of a piston. The air/fuel mixture is ignited by a spark generated by a spark plug during revolution of a crankshaft. The combustible air/fuel mixture is provided to the piston chamber by a carburetor, such as a float-type carburetor or diaphragm carburetor.

A float-type carburetor controls the level of fuel in a fuel feed reservoir by a float and inlet valve. The primary distinction between a float-type and floatless carburetor is that the float system is operative to regulate and intermittently shutoff incoming fuel when the fuel level in the fuel feed reservoir is at a pre-selected level. In the floatless or diaphragm carburetor, the fuel is pumped against an inlet needle regulated by a spring loaded diaphragm non-vented to atmosphere in a chamber between the inlet needle and the diaphragm. In general, it is preferable to use a float-type carburetor provided the environment permits (e.g., the engine is not subject to inversion). This is because float-type carburetors are more simple in construction and are vented to atmosphere, thereby avoiding the various potentially adverse effects of pressure.

When starting small internal combustion engines, it is usually necessary to pull on a starter rope several times before the engine kicks over and begins to run. Generally, after a couple of pulls on the starter rope, the engine starts and runs for a short period of time and then subsequently stops. This is what is commonly known in the field as a "false start". This "false start" phenomena has been present in the small internal combustion engine art for several years and has come to be generally accepted by the users as an acceptable starting method. The user generally has knowledge of the fuel system procedure and understands why the system is not starting.

The difficulty in starting a cold small internal combustion engine centers around the choke system of these particular engines. Starting systems for internal combustion engines, including those incorporating both float-type and floatless carburetors, typically require choking prior to starting of the engine in order to enrich the air/fuel mixture. This is especially true in either cool weather or after an extended period of non-operation. When the choke system is in a closed position, the fuel line system of a cold engine has a very high restriction in the air intake. This restriction of the air intake forms a vacuum in the fuel line, drawing fuel into the engine, via the carburetor, from the fuel tank. As the starting rope is pulled, the engine draws fuel into the carburetor by the vacuum created in the system. As the engine begins to fire, a certain amount of air is necessary to keep the engine running. With a manual choke, the user must open the choke quickly after the engine begins to run or the user will experience the "false start" phenomenon. The reason for the "false start" is that as the speed of the engine increases, the engine draws more fuel. With the choke in a closed position, however, the amount of air flow entering the engine is not increased. Thus, a proper mixture of air and fuel is not achieved and the engine dies instantly. Also, if the engine does not start up, a substantial amount of fuel is drawn into the engine, via the carburetor, causing the engine and carburetor to become flooded, thereby further hampering the starting procedure of the engine.

It is known in the art to incorporate a spring loaded air bypass valve into a choke system to allow for a time delay for permitting a start and run condition. However, this design has never provided a prolong run time to allow the engine to sufficiently warm up before the engine would quit running. Furthermore, the engine typically is left in a flooded condition, thereby requiring considerable excessive pulls of the rope to restart the engine.

Choke devices heretofore used in the field of small internal combustion engines are generally of a throttle valve type. These types of chokes incorporate a valve pivotally secured in the carburetor air/fuel mixing passage of an internal combustion engine. The throttle valve typically pivots about a central axis, flipping between a closed position (i.e., idle) and an opened position (i.e., wide open throttle). While this type of choke has proven to be commercially successful, it is associated with several disadvantages. For example, the throttle valve is either in a fully closed or a fully opened position. When starting the engine, the throttle valve is in the fully closed position. Once the engine starts, it is nearly impossible to rotate the throttle valve to its opened position, so that the engine will continue to run without stalling. Also, the throttle valve may flip from a closed position to an opened position without notice to the user. This slippage is due to the fact that, in many instances, there is no resistant member holding the throttle valve in position. Those skilled in the art are aware of yet other disadvantages of this type of throttle valve choke.

Alternatively to choking or in addition to choking, many known starting systems incorporate a fuel prime. Fuel priming generally refers to the forced introduction of fuel into the mixing passage of the carburetor prior to the starting of the internal combustion engine. Typically, after an internal combustion engine has remained inoperative for a long period of time, e.g., one to two weeks or greater, fuel in the mixing passage of the carburetor evaporates. This evaporation of fuel necessitates priming of the carburetor so that fuel is present in the mixing passage upon starting of the engine. A dry carburetor generally causes the operator to pull on the starting cord several more times than necessary as compared to when the carburetor contains an ample supply of fuel. On float-type carburetors, the primer generally comprises a compressible resilient bulb in communication with a closed chamber wherein decompression of the bulb compresses the chamber, thereby either forcing fuel directly from the bulb or compressing air which in turn forces fuel from a fuel supply chamber into an induction tract. The fuel so introduced enriches the air/fuel mixture for enhancing cold starting of the engine.

Incorporation of a fuel primer without a choke arrangement is often not sufficient for adequate startability. However, known arrangements which incorporate both a choke arrangement and a fuel primer require multiple steps to ready the engine for starting. Furthermore, conventional fuel primers are subject to over priming of the engine by the user, resulting in flooding of the engine and hampered starting.

While the disadvantages discussed above are significant, the primary drawback of the known prior art carburetor systems has been an inability to satisfy performance requirements while also remaining within emission standards. Previously, the major focus in carburetor design has been primarily directed on engine performance. This is particularly true with respect to carburetors for small internal combustion engines for agricultural and marine applications which have not been previously subjected to stringent emissions standards.

More recently, other prior carburetor systems have incorporated designs or techniques aimed specifically at the reduction of emissions. Specifically, known carburetors are often jetted lean on the high side of the carburetor (i.e., with the throttle valve wide open). This adjustment aids the carburetor in lowering emissions outputs, but often results in difficulty in providing an adequate air/fuel mixture at lower engine speeds and/or upon engine starting. Furthermore, prior known carburetor systems have also been unable to satisfactorily calibrate to accommodate particular performance and emissions requirements.

Emissions standards for small internal combustion engines are becoming increasing strict for virtually all types of applications. For example, revised emission standards for marine engines are scheduled for phase-in implementation beginning in 1996. Compliance with such increasingly stringent requirements threatens to adversely effect engine performance. In order to maintain performance and lower emissions, a known technique is to replace two-cycle engine applications with four-cycle engines. The efficiencies of four-cycle engines over two-cycle engines have long been appreciated. In two-cycle engines, air and fuel is drawn through the carburetor into the crank case of the engine and during the compressor stroke the mixture of air and fuel is bled from the engine crank case into the engine cylinder. With four-cycle engines, the air/fuel mixture is delivered directly to the intake manifold, thereby permitting use of a much leaner air/fuel ratio for comparable performance. However, this leaner air/fuel ratio hampers engine startability and often necessitates application of fuel injectors to meet startability requirements. The introduction of fuel injectors for small internal combustion engines is disadvantageous for a variety of reasons, including their weight, increased expense, and the necessity for 12 volt power.

Accordingly, in view of the above-discussed considerations, it is desired to provide an improved starting system for an internal combustion engine which improves startability and performance requirements within allowable emissions requirements. The present invention overcomes the above-discussed problems inherently associated with prior known designs by providing such an improved starting system. Thus, the present invention serves the dual purposes of providing a starting system that has improved performance and reduced emissions.

The present invention incorporates improved performance features specifically designed for a float-type carbured internal combustion engine to provide a superior starting system having improved performance characteristics and also meeting the stringent requirements of the new emission standards. In one form, the starting system of the present invention includes a float type carburetor for delivering an air/fuel mixture to an internal combustion engine. The float type carburetor includes a main body portion defining a mixing passageway and a float bowl defining a fuel cavity. The fuel cavity is in communication with the mixing passage. The starting system further includes a control assembly for controlling the volume and ratio of the air/fuel mixture delivered to the internal combustion engine by selectively establishing a vacuum operative for drawing fuel from the fuel cavity to the mixing passage and a positive source of air downstream from the carburetor. The control assembly includes an actuation member selectively movable between first and second operating positions such that the source of positive airflow is fully established when the actuation member is moved to the first operating position and the vacuum is fully established when the actuation member is moved to the second operating position.

In another preferred form, the starting system of the present invention is substantially identical to the form described in the preceding paragraph and additionally incorporates a fuel prime arrangement for enriching the air/fuel mixture delivered to the internal combustion engine from the carburetor.

It is an object of the present invention to provide a starting system for an internal combustion engine which regulates the air/fuel ratio as well as the volume of air delivered to the internal combustion engine.

It is another object of the present invention to provide a starting system for internal combustion engines which meets federal emission regulations and which is actuated in a user familiar manner to control both priming and choking of the carburetor.

From the subsequent detailed description taken in conjunction with the drawings, other objects and advantages of the present invention will become apparent to those skilled in the art.

DETAILED DESCRIPTION OF THE PREFERRED EMBODIMENTS

As required, detailed embodiments of the present invention are disclosed herein. However, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
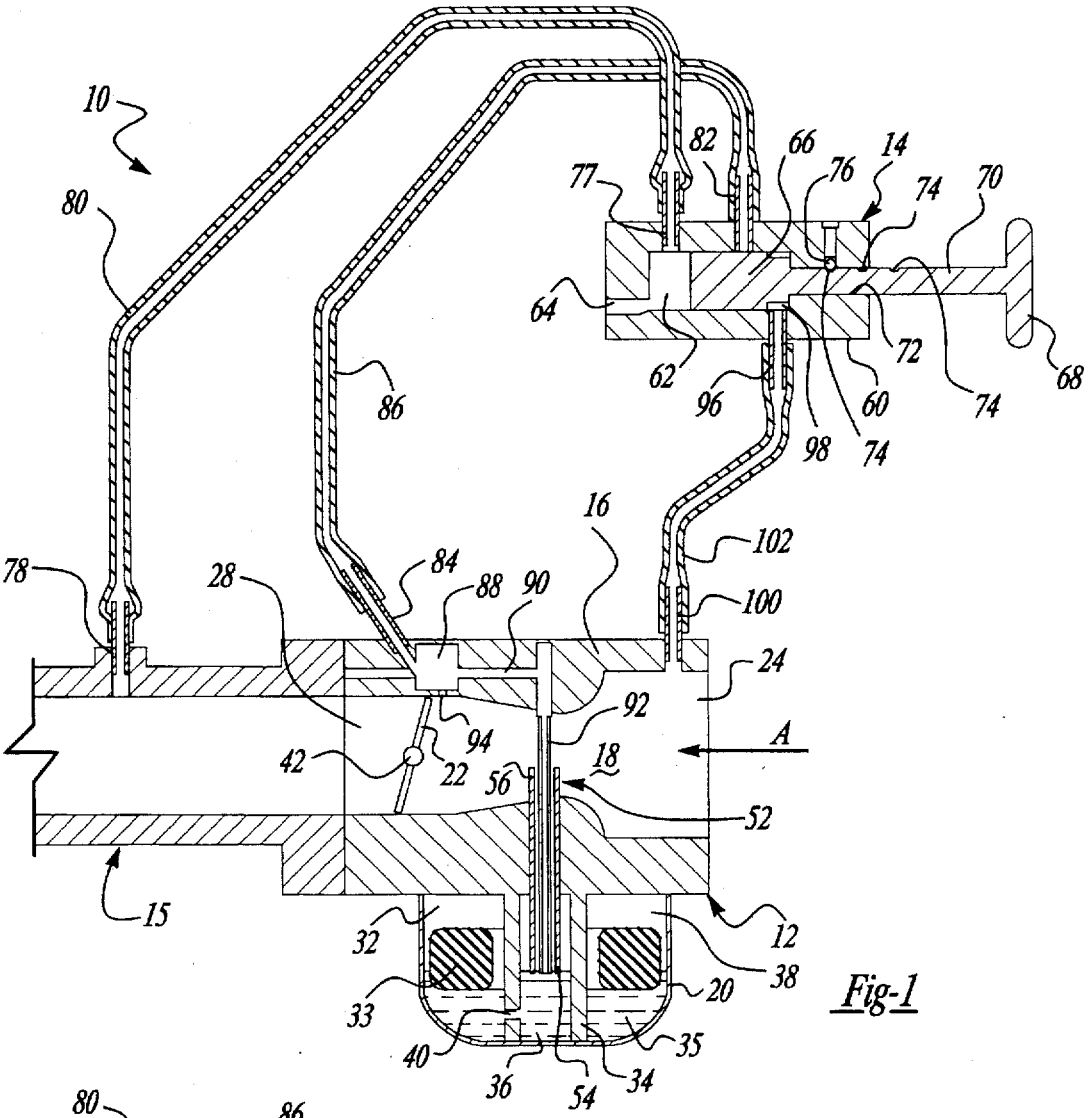
FIG. 1 is a cross-sectional view of a starting system for an internal combustion engine constructed in accordance with the teachings of a first preferred embodiment of the present invention illustrated immediately prior to starting of the internal combustion engine with a piston of the control assembly in a first operating position in which the idle air bleed port is occluded and the fast idle air port is open.
Figure 2:
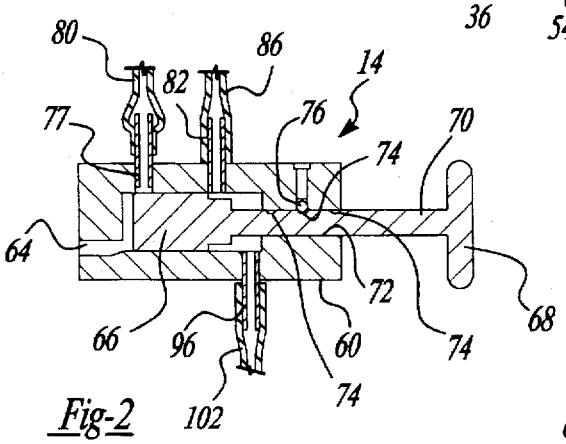
FIG. 2 is a cross-sectional view of a portion of the system of FIG. 1 illustrated during initial warm-up of the internal combustion engine with the piston of the control assembly in a second operating position in which the idle air bleed port and the fast idle air port are partially occluded by the piston.
Figure 3:
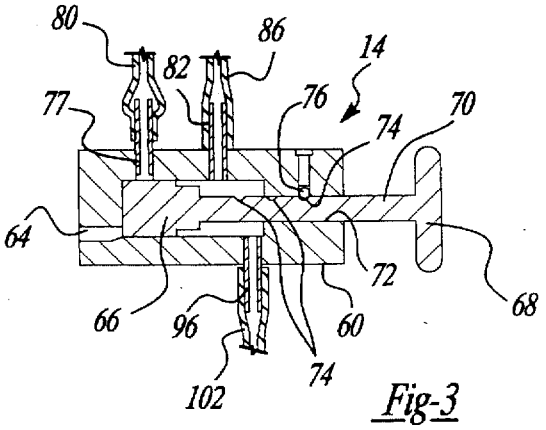
FIG. 3 is a cross-sectional view similar to FIG. 2 illustrated after the internal combustion engine has completed initial warm-up with the piston of the control assembly in a third operating position in which the idle air bleed port is open and the fast idle air port is occluded.

Referring to FIGS. 1 through 3, a starting system for an internal combustion engine constructed in accordance with a first preferred embodiment of the present invention is illustrated and generally designated with the reference numeral 10. The starting system 10 is shown to include a carburetor 12 and a control assembly 14. For purposes of illustration, the carburetor 12 and the control assembly 14 are depicted in the drawings by separate housing portions. However, it will be understood that both the carburetor 12 and control assembly 14 may be incorporated into a single housing portion.

The starting system 10 is specifically adapted for delivering an air/fuel mixture to an intake manifold 15 of an internal combustion engine (not shown). With specific reference to FIG. 1, the carburetor 12 of the starting system 10 is illustrated as a float-type carburetor and is attached to the intake manifold 15 of the internal combustion engine. It will be appreciated by those skilled in the art that while the present invention is specifically illustrated with a float-type carburetor, many of the teachings of the present invention are equally applicable for use with diaphragm-type carburetor systems. The float-type carburetor 12 has a main body portion 16 defining a mixing passage 18, a float bowl 20 and a throttle valve 22. The mixing passage 18, float bowl 20 and throttle valve 22 can be of any suitable construction well known in the art. An exemplary arrangement is further described below.

The mixing passage 18 passes through the main body portion 16 of the carburetor 12 and has an inlet 24 terminating at a first end of the main body portion 16 and an air/fuel mixture outlet 28 terminating at a second end of the main body portion 16. The inlet 24 of the main body portion 16 is positioned adjacent a source of air, such as atmospheric air. While not illustrated, it will be appreciated by those skilled in the art that it may be desired to position an air inlet manifold (not shown) between the source of air and the air inlet 24 of the mixing passage 18.

In a conventional manner, engine aspiration causes air to be drawn into the mixing passage 18 in a direction indicated in FIG. 1 by an arrow identified by reference letter A. The second end 28 of the main body portion 16 is adapted to be bolted or otherwise securely fastened to the manifold 15 of the internal combustion engine. The mixing passage 18 includes a venturi portion. As will be discussed below, the venturi portion draws air through the mixing passage 18 and creates a negative pressure for drawing fuel into the mixing passage 18 from the float bowl 20.

The float bowl 20 is connected to a fuel tank (not shown) in any suitable manner well known in the art. Preferably, the float bowl 20 defines a fuel cavity 32. Within the fuel cavity 32 is a float 33. As is known by those skilled in the art, the float 33 functions to control the level of fuel 35 within the fuel cavity 32. Preferably, a substantially cylindrical wall 34 is disposed within the float bowl 20 and extends from the bottom surface of the float bowl 20 (as shown in FIG. 1) to the upper surface of the float bowl 20 adjacent a main body portion 16 of the carburetor 12. The cylindrical wait 34 divides the cavity 32 into an atmospheric chamber 36 (outside the cylindrical waft 34) and a pressure chamber 38 (within the cylindrical wall 34). The cylindrical wall 34 includes a small hole 40 passing through the cylindrical wall 34 for maintaining a substantially constant fuel level across the entire fuel cavity 32, including the atmospheric chamber 36. The volume of the pressure chamber 38 is substantially less than the volume of the atmospheric chamber 36.

The throttle valve 22 of the carburetor operates in a substantially conventional manner to control the amount of air/fuel mixture which enters into the piston cylinder of the engine. Briefly, the throttle valve 22 is pivotally positioned across the mixing passage 18 through mounting to a rotary throttle shaft 42. The rotary throttle shaft 42 is rotatable between a first position corresponding to an idle throttle valve position (as shown in FIG. 1) and a second position corresponding to a wide open throttle (WOT) position (not shown).

The carburetor 12 of the present invention further includes a high speed nozzle 52 or other suitable means for communicating the fuel cavity 32 with the mixing passage 18. A first end 54 of the conduit preferably extends into the pressure chamber 38 of the fuel cavity 32 and a second end 56 extends into the mixing passage 18 of the carburetor 12. As is well known by those skilled in the art, passage of air through the venturi passageway creates a suction in the conduit causing fuel 35 to be drawn from the float bowl 20 into the mixing passage 18 and mixed therein with the air to form a combustible air/fuel mixture. As the flow of air through the venturi increases with increased engine speeds, the amount of air drawn into the mixing passage 18 correspondingly increases.

With continued reference to FIG. 1 and additional reference to FIGS. 2 and 3, the control assembly 14 of the starting system 10 of the first preferred embodiment of the present invention will now be detailed. The control assembly 14 is operative for controlling the volume and ratio of the air/fuel mixture delivered to the internal combustion engine by establishing a vacuum operative for drawing fuel from the fuel cavity to the mixing passage and selectively establishing a positive source of air flow downstream from the carburetor 14. The control assembly includes a main body portion 60 which defines a generally cylindrical chamber 62 which is opened at a first end 64 to atmosphere. The control assembly 14 further includes an actuation member 66 disposed within the generally cylindrical chamber 62 and selectively movable between first, second and third operating positions. In the exemplary embodiment illustrated, the actuation member comprises a piston 66 interconnected to a manually actuated knob 68 through a shaft 70 passing through a cylindrical channel 72 and extending from the main body portion 60. Importantly, the actuation member 66 is operated by the user in a familiar manner that has been employed for conventional manual choking of an internal combustion engine. In a typical application, such as for a marine engine, the control assembly 14 is mounted behind the control panel with the shaft 70 passing through an aperture therein.

While it will become apparent to those skilled in the art below that the functions of the control arrangement 14 offers significant improvements over prior known starting systems, the actuation member 66 is conventionally operated by pulling the knob 68 fully out during initial starting of the engine to its first operating position (shown in FIG. 1). After the engine turns over and begins to run, which will typically occur after approximately one to three pulls of the rope (not shown), the knob 68 can be depressed after a short period of time until the piston reaches its second operating position (shown in FIG. 2). Finally, after the engine has become sufficiently warm, the knob 68 can be fully depressed to a third operating position (shown in FIG. 3). The shaft 70 is formed to include three grooves 74 oriented to align with a detent 76 extending into the channel 72 when the piston 66 is in each of its three operating positions. In this manner, positive location is provided for the piston 66.

The control assembly 14 includes a plurality of ports which serve to control airflow to and through the carburetor 12. In principle, the control assembly 14 uses atmospheric air control feedback by controlling access to two atmospheric ports. A fast idle air port 77 is in communication with the generally cylindrical chamber 62 of the main body portion 60 and interconnected to an intake manifold inlet port 78 via a conduit 80. An idle bleed air port 82 is also in communication with the generally cylindrical chamber 62 of the main body portion 60 and is interconnected to the fuel cavity 32 of the float bowl 20. Specifically, the idle air bleed port 82 is connected to a first carburetor body inlet port 84 via a conduit 86. The first carburetor body inlet port 84 is connected to a transition pocket 88 which is formed in the main body portion 16 of the carburetor 12. The transition pocket 88 is in turn interconnected to the fuel cavity 32 of the float bowl 20 through a passageway 90 which leads to a vacuum tube 92 extending through the high-speed nozzle tube 52 and into the fuel cavity 32. Small apertures 94 are provided between the transition pocket 88 and the mixing passage 18 of the carburetor 12 adjacent the throttle valve 22. As will be discussed below, the apertures 94 provide for introduction of fuel 35 into the mixing passage 18. Finally, the control assembly 14 further includes an atmospheric port 96 which interconnects a second end 98 of the generally cylindrical cavity 62 with a source of atmospheric air. In the embodiment illustrated, the atmospheric port 96 is interconnected to a second carburetor body inlet port 100 via a conduit 102. The second carburetor body inlet port 100 is in communication with the inlet 24 of the mixing passage 18.

Figure 4:
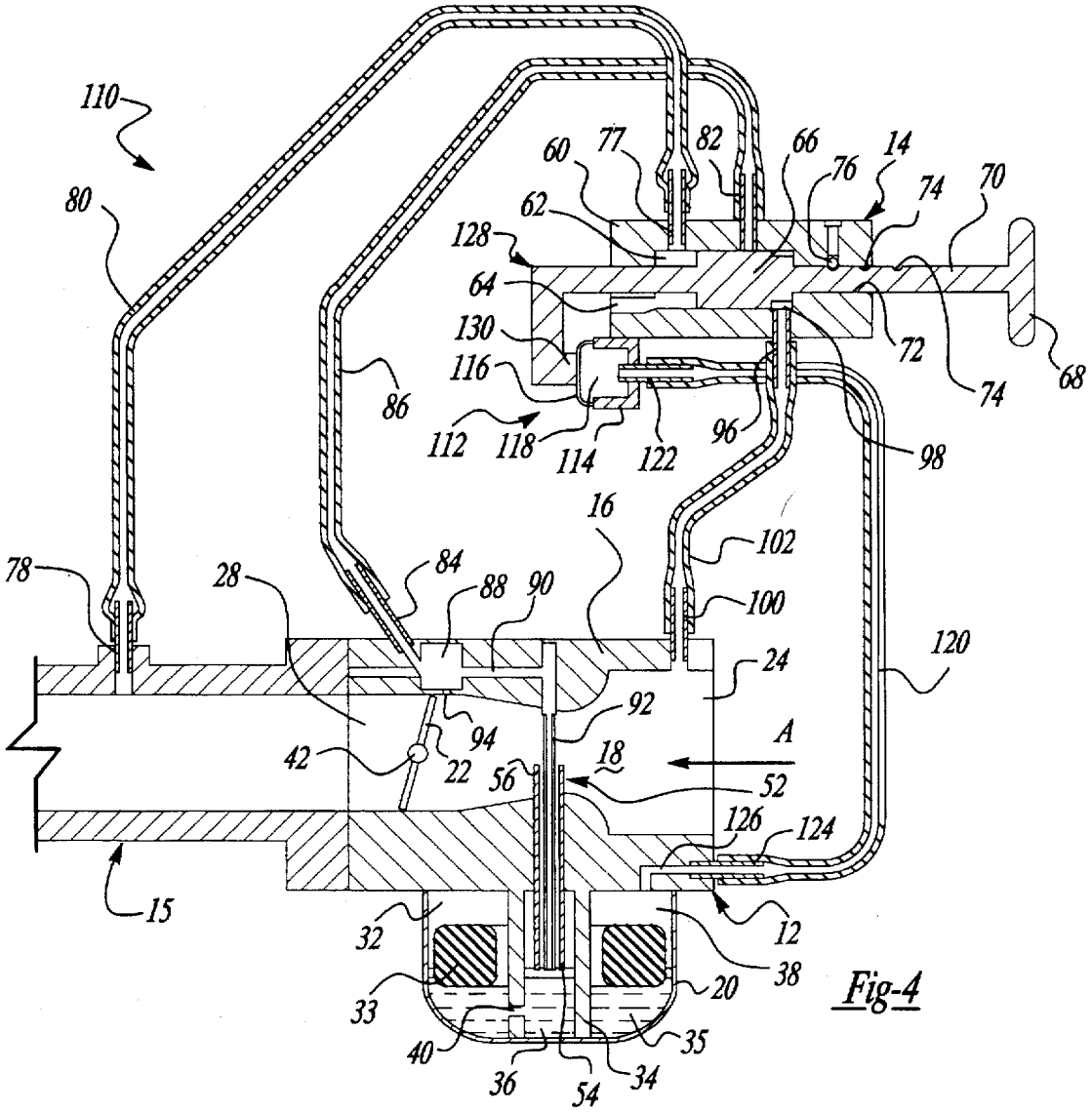
FIG. 4 is a cross-sectional view similar to FIG. 1 illustrating a cross-sectional view of a starting system for an internal combustion engine constructed in accordance with the teachings of a second preferred embodiment of the present invention.
Figure 5:
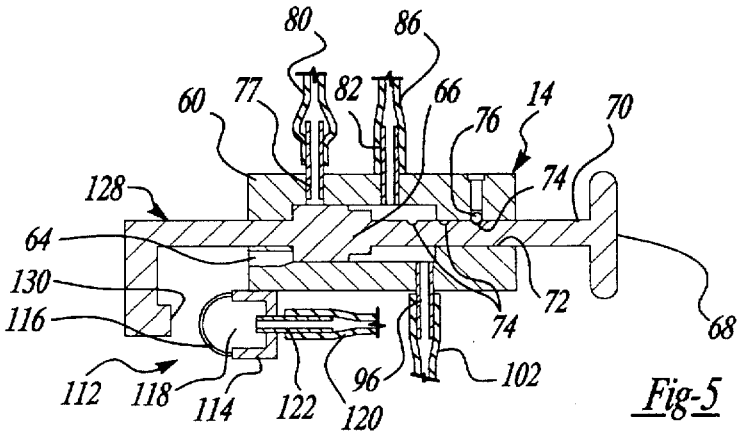
FIG. 5 is a cross-sectional view of a portion of the system of FIG. 4 similar to the cross-sectional view of FIG. 3.

Turning now to FIGS. 4 and 5, a starting system constructed in accordance with a second preferred embodiment of the present invention is illustrated and generally identified with reference numeral 110. The starting system 110 of the second preferred embodiment is to a large extent structurally and functionally identical to the starting system of the first preferred embodiment. Due to the similarity between the two disclosed embodiments, common reference numerals will be used to identify substantially identical elements. Starting system 110 differs from starting system 10 only to the extent that it incorporates a fuel prime arrangement 112 for momentarily enriching the air/fuel mixture delivered from the carburetor 12 to the internal combustion engine.

In the exemplary embodiment illustrated, the fuel prime arrangement 112 is illustrated to include a rigid base portion 114 and a resilient prime bulb 116 which corporates to define a compressible cavity 118 which is in communication with the fuel cavity 32 of the float bowl 20. The rigid portion 114 is fixedly attached to the main body portion 60 in any suitable manner. As illustrated, a conduit 120 interconnects a port 122 adjacent the rigid portion 114 of the fuel prime arrangement bulb 112 with a port 124 interconnected with a passageway 126 in direct communication with the fuel cavity 32 of the float bowl 20. The primer arrangement 112 further includes a primer pawl 128 integrally formed with the piston 66. The primer pawl 128 includes a distal end portion 130 positioned adjacent to the resilient portion 116. As the knob 68 is displaced to its first operating position (as shown in FIG. 4), the primer pawl 128 depresses the resilient portion 116 and thereby forces the air within a cavity 118 defined between the resilient portion 116 and rigid portion 114 through the outlet port 122 and eventually into the fuel cavity 32 of the float bowl 20. The resilient portion 116 is formed to include a small hole (not shown) for venting the cavity 118 to atmosphere and thereby eliminating any significant negative pressure delivered to the fuel cavity 32 upon return of the resilient member 116 to its uncompressed state (as shown in FIG. 5). Alternatively, the primer pawl 128 can be modified to include a one-way check valve (not shown) to further eliminate the possibility of any negative pressure.

In particular applications, it may be desirable to modify the control assembly so that enrichment of the air/fuel mixture delivered to the internal combustion from the carburetor occurs only when the ambient temperature is below a predetermined level. It is anticipated that such a modification may occur at the user's discretion or may result automatically. For example, the control assembly 14 could be modified to incorporate a biasing mechanism such as a coil spring surrounding a portion of the primer pawl adjacent the main body portion 60. In such an alternative arrangement, the primer arrangement would not be activated until the piston 66 is further moved rightwardly (as shown in FIG. 4) against the spring bias. This arrangement would provide the operator the opportunity to prime the engine any number of times when starting the engine during cold weather and following a period of prolonged inactivity. If it is desired to automatically adjust the system to make engine priming dependent on ambient temperature, the control assembly can alternatively be modified to incorporate a temperature sensitive spring. The temperature sensitive spring would serve to displace the resilient portion 116 of the primer arrangement 112 relative to the primer pawl 130 such that contact therebetween does not occur when the piston 66 is moved to its first operating position (as shown in FIG. 4) unless the ambient temperature is below a certain minimum value.

It will be appreciated by those skilled in the art that the fuel prime arrangement 112 illustrated throughout the drawings provides enhance starting of the engine particularly during cold weather and following prolong periods of inactivity. However, such an arrangement will not be necessary for each application of the present invention. In this regard, it is anticipated that incorporation of the fuel prime arrangement 112 will not be necessary for applications of the present invention where the ambient temperature is not expected to drop below approximately 50° to 60° F.

With reference now to FIGS. 1–3, operation of the starting system 10 of the preferred embodiment of the present invention will now be described. With initial reference to FIG. 1, the knob 68 is pulled outwardly from the main body portion 60 of the control assembly 14, thereby displacing the piston 66 to its first operating position. In the first operating position, atmospheric air is permitted to enter the first end 64 of the cylindrical cavity 62 and pass through the conduit 80 to the intake manifold inlet port 78. At the same time, the piston 66 closes the idle air bleed port 82. Starting of the engine typically occurs following three to four pulls of the start rope. At this point, the engine will start and run at a fast idle speed controlled by the additional atmospheric air routed through the open port 77 to the intake manifold 15.

After the engine has been permitted to warm up for approximately 60 seconds, the knob 68 may be pushed in to advance the piston to one of the second operating position (shown in FIG. 2) or the third operating position (shown in FIG. 3). The decision to advance the piston 66 to the second operating position or the third operating position will be primarily dependent on the ambient temperature condition. If it is desired to further warm the engine, the piston 66 is displaced to the second operating position and the idle air bleed port 82 and the fast idle air port 77 are both in a partially opened condition. The partially opened condition of the idle air bleed port creates a negative pressure in the transition pocket 88 and thereby serves to draw fuel 35 from the fuel cavity 32 through the conduit 92, through the passageway 90 and into the transition pocket 88. From the transition pocket 88, the fuel 35 is introduced into the mixing passage 18 through the plurality of apertures 94 adjacent throttle valve 22. By leaving the fast idle air port 77 partially opened, a somewhat lesser, but still increased amount of atmospheric air is routed to the intake manifold 15 to increase the idle speed of the engine. In this operating position, the engine is operational.

When the engine becomes completely warmed up, the knob 68 can be fully depressed to thereby advance the piston to its third operating position. Now, the efficiency of the engine has been maximized and the idle speed can be reduced. In the third operating position, the piston 66 occludes the fast idle input port 77 effectively reducing the amount of atmospheric air routed to the intake manifold and lowering the idle speed of the engine. Simultaneously, the piston 66 fully opens the idle air bleed port 82 to atmosphere, thereby increasing the negative pressure in the transition pocket 88 and resultingly increasing the amount of air drawn into the transition pocket 88.

Turning now to FIGS. 4 and 5, the operation of the fuel prime arrangement 112 incorporated into the starting arrangement 110 of the second preferred embodiment of the present invention will now be described. It will be understood by those skilled in the art that the functions described immediately above with respect to FIGS. 1–3 are identically accomplished during operation of the starting arrangement 110. In addition thereto, the knob 68 is pulled outwardly to thereby advance the piston 66 to its first operating position (as shown in FIG. 4). The fuel prime arrangement 112 is automatically actuated. In this regard, as the piston 66 advances rightwardly, the distal end 130 of the primer pawl 128 is forced against the resilient portion 116, thereby momentarily reducing the volume of air in the cavity 118. The volume of air is forced through the outlet 122, conduit 120, inlet 124, passageway 126, and into the fuel cavity 32. This additional air introduced to the fuel cavity 32 pressurizes the fuel cavity 32, thereby momentarily forcing an additional amount of fuel through the high speed nozzle 52 and into the passageway 18 of the carburetor 12. As a result, the air/fuel mixture delivered to the internal combustion engine from the carburetor 12 is momentarily enriched to thereby facilitate starting of the engine during periods of prolonged inactivity or cold ambient temperatures.

While it will be apparent to those skilled in the art, the preferred embodiments are well calculated to fulfill the above-stated objects, it will be also appreciated that the present invention is susceptible to further modification, variation and alteration without departing from the scope and spirit of the claims as set forth below.

What is claimed is:

1. An apparatus for controlling the volume and ratio of an air/fuel mixture delivered from a carburetor to an intake manifold of an internal combustion engine, the carburetor of the type including a mixing passage interconnecting a source of air and the internal combustion engine, and a fuel cavity, the fuel cavity being in communication with the mixing passage, the apparatus comprising:

a housing defining a chamber;

a first port in selective communication with said chamber, said first port interconnected to the intake manifold;

a second port in selective communication with said chamber, said second port interconnected to the fuel cavity; and an actuation member operative for selectively opening and closing said first and second ports;

whereby the apparatus operates to control the volume and ratio of the air/fuel mixture delivered to the internal combustion engine by selectively establishing a negative pressure via said second port for drawing fuel from the fuel cavity to the mixing passage and selectively providing a source of positive, atmospheric air flow via said first port downstream from the carburetor.

2. The apparatus for controlling the volume and ratio of an air/fuel mixture delivered from a carburetor to an intake manifold of an internal combustion engine of claim 1, wherein said actuation member is movable between first and second operating positions such that when said actuation member is in said first operating position said first port is fully open and said second port is fully closed and when said actuation member is in said second operating position said first port is fully closed and said second port is fully open.

3. The apparatus for controlling the volume and ratio of an air/fuel mixture delivered from a carburetor to an intake manifold of an internal combustion engine of claim 2 wherein said actuation member is further movable to a third operating position in which said first port is partially open and said second port is partially open.

4. The apparatus for controlling the volume and ratio of an air/fuel mixture delivered from a carburetor to an intake manifold of an internal combustion engine of claim 3, wherein said chamber is open to atmosphere.

5. The apparatus for controlling the volume and ratio of an air/fuel mixture delivered from a carburetor to an intake manifold of an internal combustion engine of claim 2, wherein said control assembly includes a main body portion defining a chamber and further wherein said actuation member comprises a piston disposed within said chamber.

6. The apparatus for controlling the volume and ratio of an air/fuel mixture delivered from a carburetor to an intake manifold of an internal combustion engine of claim 2, wherein opening of said second port is operative for delivering a source of negative pressure to the carburetor.

7. The apparatus for controlling the volume and ratio of an air/fuel mixture delivered from a carburetor to an intake manifold of an internal combustion engine of claim 1, wherein said first port and the intake manifold are interconnected through a flexible conduit.

8. The apparatus for controlling the volume and ratio of an air/fuel mixture delivered from a carburetor to an intake manifold of an internal combustion engine of claim 3, further including a fuel prime arrangement operative for enriching the air/fuel mixture delivered to the intake manifold in response to movement of said actuation member to said first position.

9. The apparatus for controlling the volume and ratio of an air/fuel mixture delivered from a carburetor to an intake manifold of an internal combustion engine of claim 8, wherein said fuel prime arrangement includes a prime bulb in communication with said fuel cavity.

10. A starting system for an internal combustion engine having an intake manifold and a carburetor, the starting system comprising:

a control assembly for controlling the volume and ratio of an air/fuel mixture delivered to the intake manifold, the control assembly comprising:

(a) a housing defining a chamber;

(b) a first port in selective communication with said chamber, said first port interconnected to the intake manifold;

(c) a second port in selective communication with said chamber;

(d) an actuation member selectively operable for opening and closing said first and second ports and selectively providing a source of positive, atmospheric air flow downstream from the carburetor; and said carburetor being in communication with said intake manifold and interconnected to said second port, said carburetor including:

(a) a main body portion defining a mixing passage for delivering said air/fuel mixture to the internal combustion engine;

(b) a fuel cavity in communication with said mixing passage whereby a negative pressure draws fuel from the fuel cavity into the mixing passage; and (c) a transition pocket interdisposed between said fuel cavity and said second port, said transition pocket including an aperture in communication with said mixing passage.

11. The starting system for an internal combustion engine having an intake manifold of claim 10, wherein said actuation member is movable between first and second operating positions such that when said actuation is in said first operating position said first port is fully open and said second port is fully closed and when said actuation member is in said second operating position said first port is fully closed and said second port is fully open.

12. The starting system for an internal combustion engine having an intake manifold of claim 11, wherein said actuation member is further movable to a third operating position in which said first port is partially open and said second port is partially open.

13. The starting system for an internal combustion engine having an intake manifold of claim 12, wherein said chamber is open to atmosphere.

14. The starting system for an internal combustion engine having an intake manifold of claim 11, wherein said control assembly includes a main body portion defining a chamber and further wherein said actuation member comprises a piston disposed within said chamber.

15. The starting system for an internal combustion engine having an intake manifold of claim 11, wherein opening of said second port is operative for delivering a source of negative pressure to the carburetor.

16. The starting system for an internal combustion engine having an intake manifold of claim 11, wherein said first port and the intake manifold are interconnected through a flexible conduit.

17. The starting system for an internal combustion engine having an intake manifold of claim 11, further including a fuel prime arrangement operative for enriching the air/fuel mixture delivered to the intake manifold in response to movement of said actuation member to said first position.

18. The starting system for an internal combustion engine having an intake manifold of claim 17, wherein said fuel prime arrangement includes a prime bulb in communication with said fuel cavity.

19. A system for controlling the volume and ratio of an air/fuel mixture delivered from a float-type carburetor to an internal combustion engine, the float-type carburetor of the type including a mixing passage interconnecting a source of air and the internal combustion engine, and a float bowl defining a fuel cavity, the fuel cavity being in communication with the mixing passage, the apparatus comprising:

a fuel primer arrangement including a resilient member and a rigid member, said resilient member and said rigid member defining an air cavity, said air cavity being in fluid communication with said fuel cavity; and an actuation member including a primer pawl disposed adjacent to said resilient member and a manually controlled knob, said actuation member moveable between a first operating position and a second inward operating position such that movement of said actuation member from said second inward position to said first position causes said primer pawl to at least partially collapse said cavity, thereby pressurizing the fuel cavity.

20. The system for controlling the volume and ratio of an air/fuel mixture delivered from a float-type carburetor to an internal combustion engine of claim 19, further comprising:

a housing defining a chamber;

a first port in selective communication with said chamber, said first port interconnected to the intake manifold;

a second port in selective communication with said chamber, said second port interconnected to the fuel cavity;

said actuation member further including a piston portion; and whereby movement of said actuation member to said first operating position causes said piston portion to open said first port and close said second port, and movement of said actuation member to said second operating position causes said piston portion to close said first port and open said second port.

21. An apparatus for controlling the volume and ratio of an air/fuel mixture delivered from a carburetor to an intake manifold of an internal combustion engine, the carburetor of the type including a mixing passage interconnecting a source of air and the internal combustion engine, and a fuel cavity, the fuel cavity being in communication with the mixing passage, the apparatus comprising:

a housing defining a chamber;

a first port in selective communication with said chamber, said first port interconnected to the intake manifold;

a second port in selective communication with said chamber, said second port interconnected to the fuel cavity;

an actuation member operative for selectively opening and closing said first and second ports wherein said actuation member is moveable between first, second and third operating positions such that when said actuation member is in said first operating position said first port is fully open and said second port is fully closed, when said actuation member is in said second operating position said first port is fully closed and said second port is fully open, and when said actuation member is in said third operating position said first port is partially open and said second port is partially open; and a fuel prime arrangement operative for enriching the air/fuel mixture delivered to the intake manifold in response to movement of said actuation member to said first position;

whereby the apparatus operates to control the volume and ratio of the air/fuel mixture delivered to the internal combustion engine by selectively establishing a negative pressure via said second port for drawing fuel from the fuel cavity to the mixing passage and selectively providing a source of positive air flow via said first port downstream from the carburetor.

22. The apparatus for controlling the volume and ratio of an air/fuel mixture delivered from a carburetor to an intake manifold of an internal combustion engine of claim 21, wherein said fuel prime arrangement includes a prime bulb in communication with said fuel cavity.

23. A starting system for an internal combustion engine having an intake manifold, the starting system comprising:

a control assembly for controlling the volume and ratio of an air/fuel mixture delivered to the intake manifold, the control assembly comprising:

(a) a housing defining a chamber;

(b) a first port in selective communication with said chamber, said first port interconnected to the intake manifold;

(c) a second port in selective communication with said chamber;

(d) an actuation member selectively operable for opening and closing said first and second ports;

wherein said actuation member is moveable between said first and second operating positions such that when said actuation is in said first operating position said first port is fully open and said second port is fully closed and when said actuation member is in said second operating position said first port is fully closed and said second port is fully open; and a carburetor in communication with said intake manifold and interconnected to said second port, said carburetor including:

(a) a main body portion defining a mixing passage for delivering said air/fuel mixture to the internal combustion engine;

(b) a fuel cavity in communication with said mixing passage;

(c) a transition pocket interdisposed between said fuel cavity and said second port, said transition pocket including an aperture in communication with said mixing passage; and (d) a fuel prime arrangement operative for enriching the air/fuel mixture delivered to the intake manifold in response to movement of said actuation member to said first position.

24. The starting system for an internal combustion engine having an intake manifold of claim 23, wherein said fuel prime arrangement includes a prime bulb in communication with said fuel cavity.

* * * * *